US010462563B2

(12) United States Patent
Chao et al.

(10) Patent No.: US 10,462,563 B2
(45) Date of Patent: Oct. 29, 2019

(54) SOUND PLAYING DEVICE AND CONNECTION ESTABLISHING METHOD THEREOF

(71) Applicant: Unlimiter MFA Co., Ltd., Eden Island (SC)

(72) Inventors: Kuan-Li Chao, Taipei (TW); Kuo-Ping Yang, Taipei (TW); Jian-Ying Li, Taipei (TW); Neo Bob Chih-Yung Young, Taipei (TW); Po-Jui Wu, Taipei (TW)

(73) Assignee: UNLIMITER MFA CO., LTD., Eden Island (SC)

( * ) Notice: Subject to any disclaimer, the term of this patent is extended or adjusted under 35 U.S.C. 154(b) by 0 days.

(21) Appl. No.: 16/161,147

(22) Filed: Oct. 16, 2018

(65) Prior Publication Data

US 2019/0261083 A1 Aug. 22, 2019

(30) Foreign Application Priority Data

Feb. 22, 2018 (TW) ..... 107106012 A

(51) Int. Cl.
*H04R 3/00* (2006.01)
*H04R 29/00* (2006.01)

(52) U.S. Cl.
CPC ..... *H04R 3/00* (2013.01); *H04R 29/001* (2013.01); *H04R 2420/07* (2013.01)

(58) Field of Classification Search
CPC ..... H04R 3/00; H04R 29/001; H04R 2420/07
USPC ..... 381/58
See application file for complete search history.

(56) References Cited

U.S. PATENT DOCUMENTS

2014/0073244 A1* 3/2014 Ko ..... H04W 76/14 455/41.1
2016/0359766 A1* 12/2016 Pawar ..... H04L 1/16
2016/0366263 A1* 12/2016 Song ..... H04W 4/90

* cited by examiner

*Primary Examiner* — Vivian C Chin
*Assistant Examiner* — Douglas J Suthers
(74) *Attorney, Agent, or Firm* — Bacon & Thomas, PLLC

(57) ABSTRACT

A sound playing device and a connection establishing method thereof are disclosed. The sound playing device comprises a wireless transmission module, a detection module, and a control module. The wireless transmission module is used for establishing a connection with an electronic device via a first or a second wireless transmission path, wherein the first and the second wireless transmission path are used for receiving an audio signal and a data signal respectively. The detection module detects whether the wireless transmission module is connected to the electronic device via the first or the second wireless transmission path. When the detection module detects that the electronic device is to be connected via the second wireless transmission path, it further detects whether the electronic device is connected via the first wireless transmission path. If yes, then the control module enables the connection via the second wireless transmission path.

12 Claims, 5 Drawing Sheets

SOUND PLAYING DEVICE AND CONNECTION ESTABLISHING METHOD THEREOF

BACKGROUND OF THE INVENTION

1. Field of the Invention

The present invention relates to a sound playing device, and more particularly, to a sound playing device which can effectively perform data transmission and a connection establishing method thereof.

2. Description of the Related Art

As technology advances, technical solutions for connecting an electronic device and a sound playing device via a wireless transmission means have been developed. For example, by using a Bluetooth communication protocol to connect the electronic device with the sound playing device, the electronic device can transmit the sound to the sound playing device. In addition to the transmission path for transmitting the sound, a transmission path for transmitting data can be provided for the electronic device to transmit the data through this transmission path to control the sound playing device to change the volume or frequency of the produced sound. However, in the prior art, the electronic device and the sound playing device generally determine whether to maintain the connection between them by detecting whether there is an existing transmission path for transmitting the sound.

Please refer to FIG. 1, which illustrates a flowchart of a method for establishing connection in the prior art.

First a first electronic device 92 proceeds to step S101 to be paired with a sound playing device 91. Then the first electronic device 92 proceeds to step S102 to request to connect with the sound playing device 91 via a sound transmission path. At this time, the sound playing device 91 directly proceeds to step S103, and is connected to the first electronic device 92 via the sound transmission path. And the first electronic device 92 can also proceed to step S104 to request to connect with the sound playing device 91 via a data transmission path. The sound playing device 91 then proceeds directly to step S105 to be connected to the first electronic device 92 via a second wireless transmission path (data transmission path) and does not consider connection via the sound transmission path.

Then the first electronic device 92 can proceed to step S106 to request to cut off the connection via the sound transmission path. At this time, the sound playing device 91 directly proceeds to step S107 to cut off the connection via the sound transmission path, and the sound playing device 91 does not consider whether there is a data transmission path between the first electronic device 92 and the sound playing device 91. If a second electronic device 93 at this time proceeds to step S108 and S109 to be paired and connected with the sound playing device 91 via the sound transmission path, since the first electronic device 92 and the sound playing device 91 are no longer connected via the sound transmission path, therefore the sound playing device 91 can directly proceeds to step S110 to connect with the second electronic device 93 via the sound transmission path. However, when the second electronic device 93 further proceeds to step S111 to request to connect with the sound playing device 91 via the data transmission path, since it is possible that the first electronic device 92 remained connected with the data transmission path, then in step S112 the sound playing device 91 is not able to connect to the second electronic device 93 via the data transmission path.

As described above, it is often the case that when the sound transmission path between the connection between the first electronic device 92 and the sound playing device 91 is cut off, the data transmission path is not cut off. Therefore, another device such as the second electronic device 93 could fail to connect normally with the sound playing device 91 because the original data transmission path is still occupied.

Therefore, it is necessary to propose a new sound playing device and a connection establishing method thereof, so as to solve the problems of the prior art.

SUMMARY OF THE INVENTION

It is an object of the present invention is to provide a sound playing device which can effectively perform data transmission.

It is another object of the present invention to provide a connection establishing method for the sound playing device as described above.

In order to achieve the above object, the sound playing device of the present invention is connected to an electronic device. The sound playing device comprises a sound module, a wireless transmission module, a detection module, and a control module. The sound module is used for producing a sound signal. The wireless transmission module is used for establishing connection with the electronic device via a first wireless transmission path or a second wireless transmission path, wherein the first wireless transmission path is used for receiving an audio signal, the second wireless transmission path is used for receiving a data signal. The detection module is electrically connected with the wireless transmission module and is used for detecting whether the wireless transmission module is connected to the electronic device via the first wireless transmission path or the second wireless transmission path. The control module is electrically connected with the sound module and the detection module, the control module is used for controlling the sound module to produce the sound signal; when the detection module detects that the electronic device is to be connected via the second wireless transmission path, the detection module detects whether the electronic device is connected via the first wireless transmission path; if yes, then the control module enables the connection via the second wireless transmission path; if no, then the control module disables the connection via the second wireless transmission path.

The connection establishing method of the present invention comprises the following steps: detecting whether a wireless transmission module is connected to the electronic device via a first wireless transmission path or a second wireless transmission path, wherein the first wireless transmission path is used for receiving an audio signal and the second wireless transmission path is used for receiving a data signal; when the electronic device is to be connected via the second wireless transmission path, detecting whether the electronic device is connected via the first wireless transmission path; if yes, then enabling the connection via the second wireless transmission path; and if no, then disabling the connection via the second wireless transmission path.

DETAILED DESCRIPTION OF THE PREFERRED EMBODIMENTS

For better understanding of the technical features of the present invention, preferred embodiments are described below.

Figure 1:
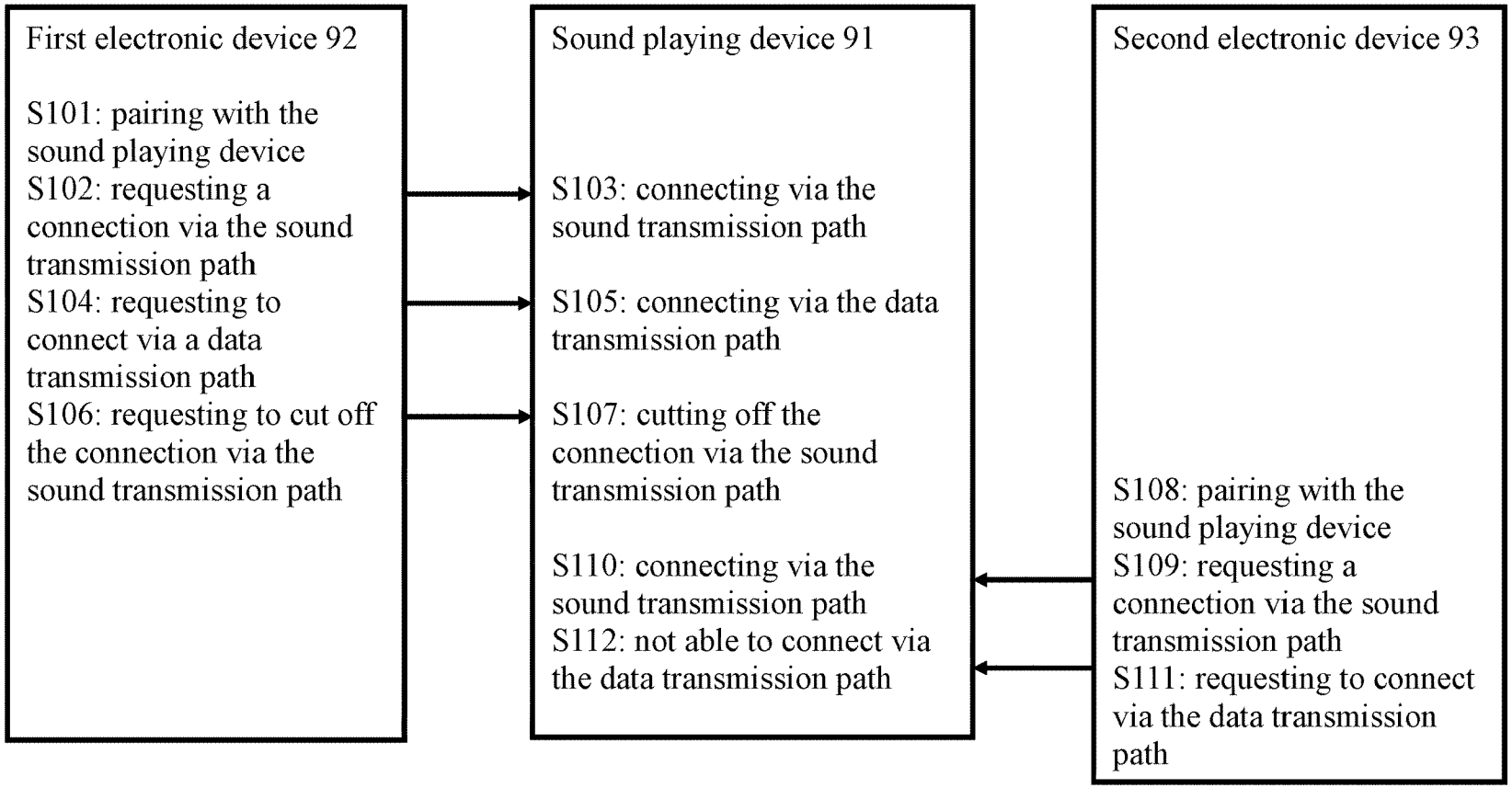
Fig.1 (Prior Art)
FIG. 1 illustrates a flowchart of a method for establishing connection in the prior art.
Figure 2:
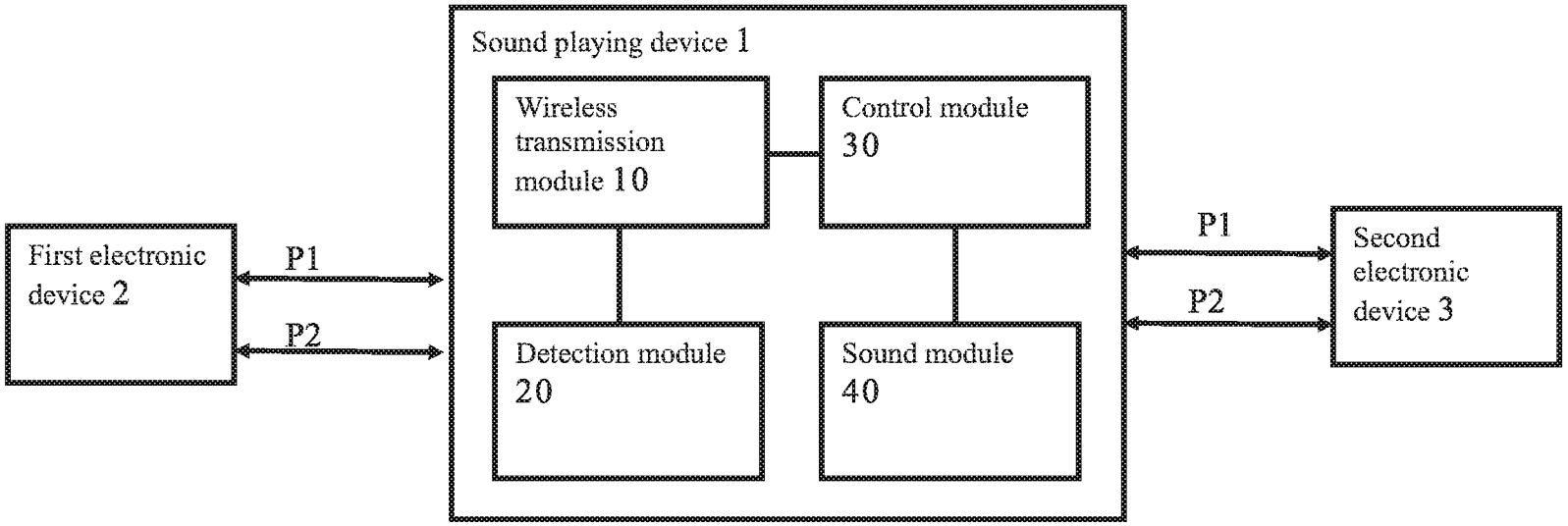
FIG. 2 illustrates a structural view of a connection between a sound playing device and an electronic device of the present invention.

Now please first refer to FIG. 2, which illustrates a structural view of a connection between a sound playing device and an electronic device of the present invention.

A sound playing device 1 of the present invention can be a headphone device or a wireless speaker which can be connected with a first electronic device 2 or a second electronic device 3. The first electronic device 2 or the second electronic device 3 can be smart phones, tablet PCs, notebook PCs or the like. The sound playing device 1 comprises a wireless transmission module 10, a detection module 20, a control module 30, and a sound module 40. The wireless transmission module 10 is used for establishing connection with the first electronic device 2 via a first wireless transmission path P1 or a second wireless transmission path P2, wherein the first wireless transmission path P1 and the second wireless transmission path P2 are both Bluetooth communication protocol compliant connections, and the first wireless transmission path P1 is used by the sound playing device 1 to receive an audio signal. The second wireless transmission path P2 is a Bluetooth Low Energy (BLE)-compliant connection, and the second wireless transmission path P2 is used by the sound playing device 1 to receive a data signal. When the first electronic device 2 performs a sound adjustment process to change the volume or frequency of the produced sound of the sound playing device 1, the first electronic device 2 transmits the data signal to the sound playing device 1 via the second wireless transmission path P2.

The detection module 20 is electrically connected with the wireless transmission module 10 and is used for detecting whether the wireless transmission module 10 is connected to the first electronic device 2 via the first wireless transmission path P1 or the second wireless transmission path P2. The detection module 20 further records the transmission addresses of the first wireless transmission path P1 and the second wireless transmission path P2, wherein the first wireless transmission path P1 and the second wireless transmission path P2 can have the same transmission address or different transmission addresses; therefore, the detection module 20 records the transmission addresses of the first wireless transmission path P1 and the second wireless transmission path P2 simultaneously to indicate connections from the first electronic device 2.

The control module 30 is electrically connected with the detection module 20 and the sound module 40. The control module 30 can adjust the sound signal produced by the sound module 40 according to the data signal. In addition, when the detection module 20 detects that the first electronic device 2 is going to perform a sound adjustment process and is connected via the second wireless transmission path P2, the control module 30 determines whether there is a connection via the first wireless transmission path P1. If the first wireless transmission path P1 is already connected, then the first electronic device 2 is allowed to establish a connection via the second wireless transmission path P2. If the first wireless transmission path P1 is not connected yet, then the control module 30 does not allow the first electronic device 2 to establish a connection via the second wireless transmission path P2. When the detection module 20 detects that the first electronic device 2 requests to cut off the connection via the first wireless transmission path P1, the control module 30 forces the wireless transmission module 10 to cut off connection with first electronic device 2 via the second wireless transmission path P2. Therefore, when the wireless transmission module 10 further tries to establish a connection with the second electronic device 3, the connection does not fail because the second wireless transmission path P2 is no longer associated with the first electronic device 2. Finally the sound module 40 produces the sound signal, wherein the sound signal can be an audio signal or an audio signal processed according to the data signal, or the like, but the present invention is not limited thereto.

It is noted that each module of the sound playing device 1 can be a hardware device, a software program combined with a hardware device, a firmware combined with a hardware device, or the like, but the present invention does not limit to the above implementations. In addition, the present embodiment only exemplifies preferred embodiments of the present invention. For the sake of brevity, all possible combinations are not described in detail. However, it should be understood by those skilled in the art that the above modules or components may not be necessary. In order to implement the present invention, other conventional modules or elements in detail may also be included. Each module or component may be omitted or modified as required, and any module or component may or may not exist between any two modules.

Figure 3:
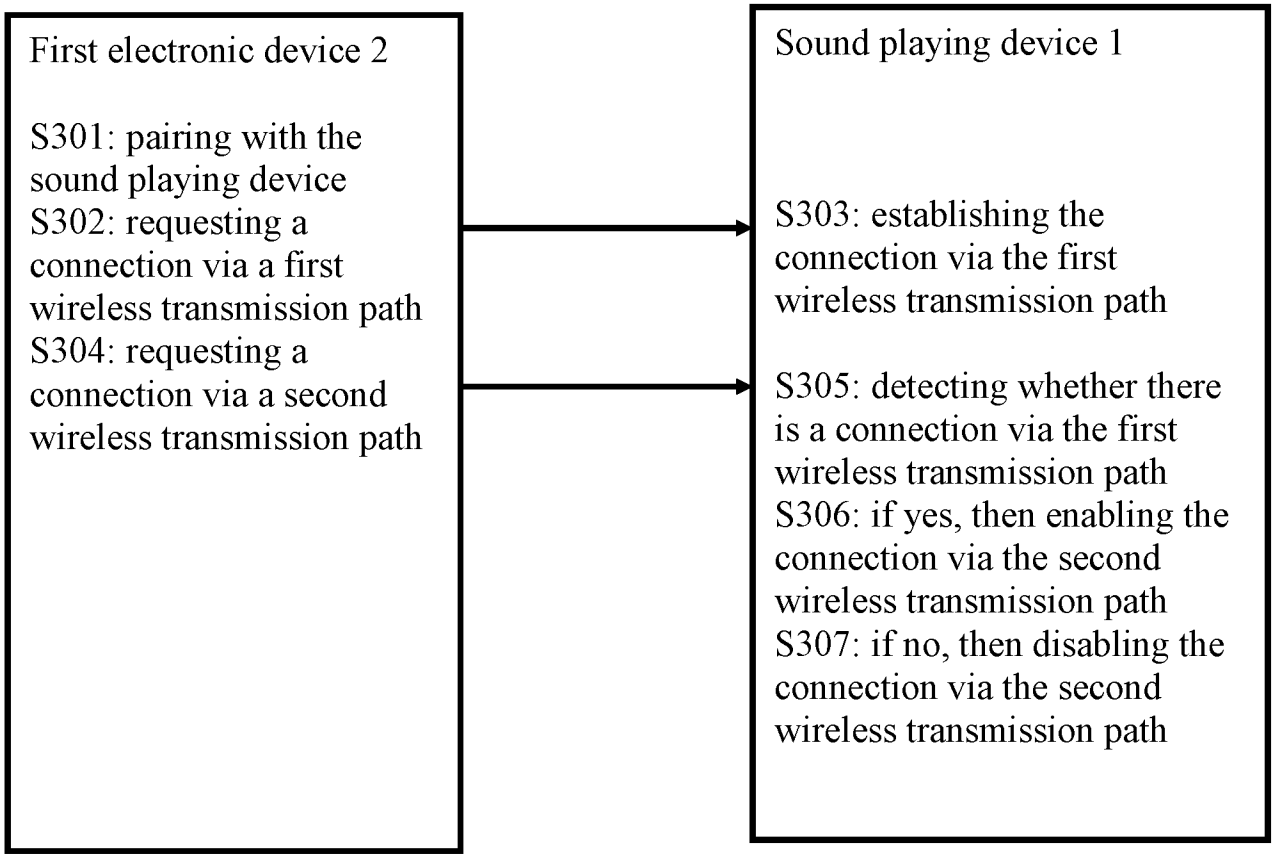
FIG. 3 illustrates a flowchart of a connection establishing method of a first embodiment of the present invention.

Now please refer to FIG. 3 for a flowchart of a connection establishing method of a first embodiment of the present invention. It is noted that although the sound playing device 1 described above is used as an example to illustrate the connection establishing method of the present invention, the connection establishing method of the present invention is not limited to the structure of sound playing device 1.

In a first embodiment, the first electronic device 2 requests a connection. First the first electronic device 2 proceeds to step S301 to be paired with a sound playing device.

First the first electronic device 2 is paired with the sound playing device 1.

Then the process proceeds to step S302 to request a connection via a first wireless transmission path.

Then the first electronic device 2 requests to connect with the sound playing device 1 via a first wireless transmission path P1.

At this time the sound playing device 1 proceeds to step S303 to establish a connection via the first wireless transmission path.

The sound playing device 1 establishes a connection with the first electronic device 2 via the first wireless transmission path P1.

The first electronic device 2 can also proceed to step S304 to request a connection via a second wireless transmission path.

The first electronic device 2 can also perform a sound adjustment process and establishes a connection via the second wireless transmission path P2.

Then the sound playing device 1 proceeds to step S305 to detect whether there is a connection via the first wireless transmission path.

The detection module 20 detects whether the wireless transmission module 10 is connected via the first wireless transmission path P1, that is, whether the steps S302 and S303 are performed.

Then the process proceeds to step S306: if yes, then enabling a connection via the second wireless transmission path, or the process proceeds to step S307: if no, then disabling a connection via the second wireless transmission path.

If the first wireless transmission path P1 is already connected, then the control module 30 allows the first electronic device 2 to establish a connection via the second wireless transmission path P2, as described in step S306. If the first wireless transmission path P1 is not connected yet, then the control module 30 does not allow the first electronic device 2 to establish a connection via the second wireless transmission path P2, as described in step S307.

Figure 4A:
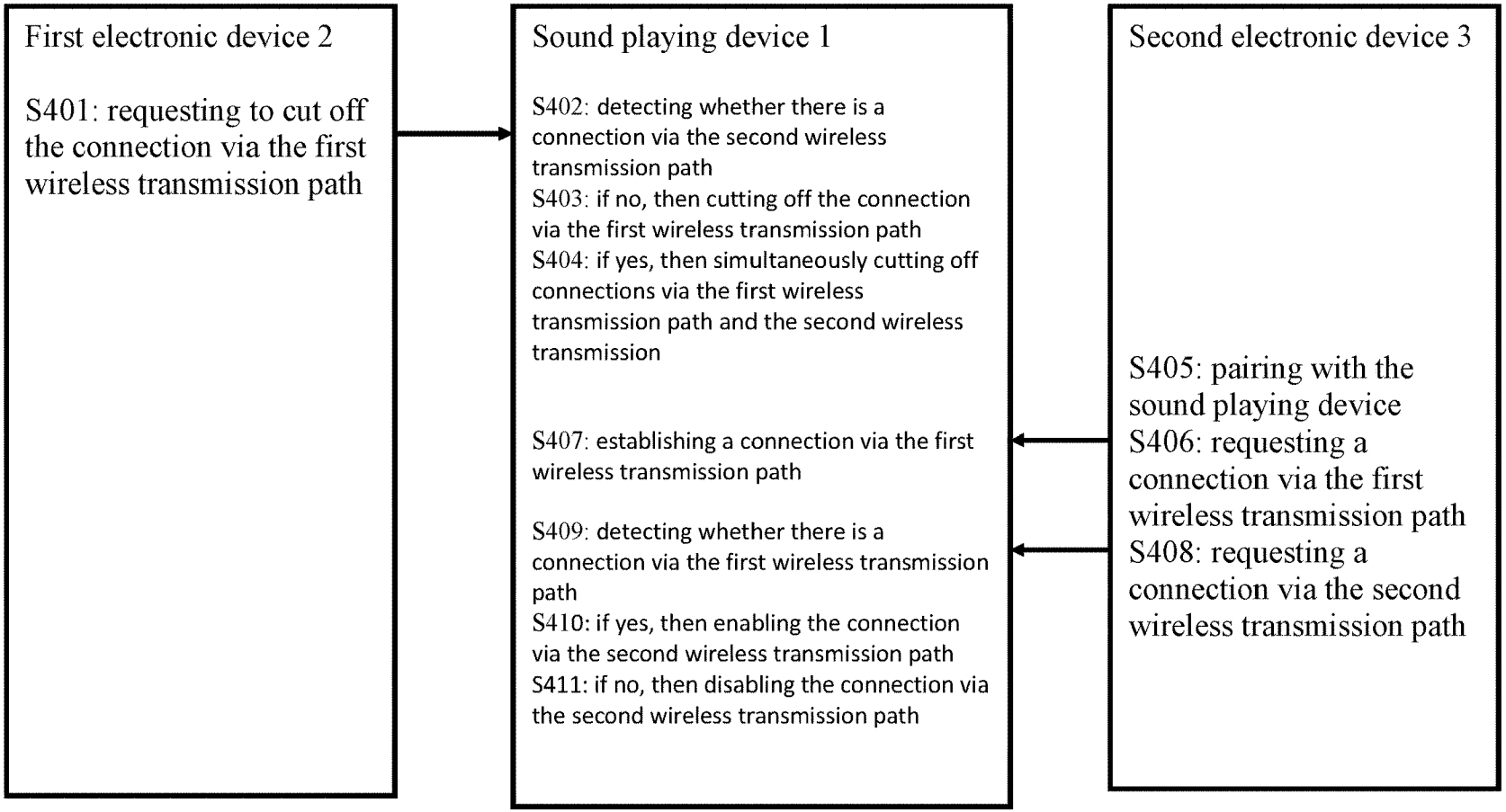
FIGS. 4A and 4B illustrate flowcharts a connection establishing method of a second embodiment of the present invention.
Figure 4B:
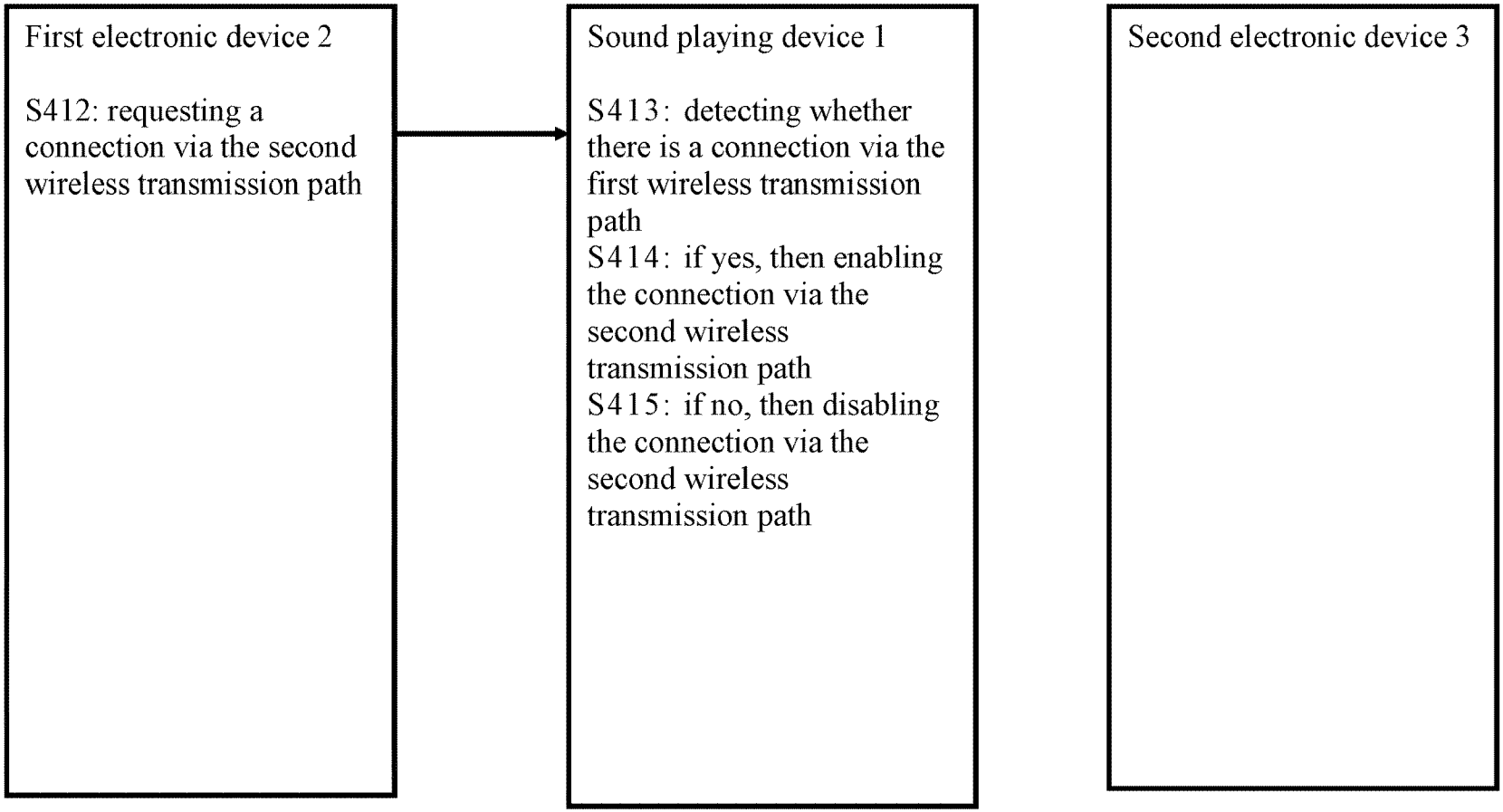

Please now refer to FIGS. 4A and 4B for flowcharts of a connection establishing method of a second embodiment of the present invention The second embodiment describes the steps of the second electronic device 3 requesting to establish a connection after the first electronic device 2 requesting to cut off the connection. First the first electronic device 2 proceeds to step S401 to request to cut off the connection via the first wireless transmission path, then the sound playing device 1 proceeds to step S402 to detect whether there is a connection via the second wireless transmission path.

At this time the sound playing device 1 uses the detection module 20 to detect whether the first electronic device 2 is also connected via the second wireless transmission path P2.

Then the process proceeds to step S403: if no, then cutting off the connection via the first wireless transmission path, or to step S404: if yes, then simultaneously cutting off connections via the first wireless transmission path and the second wireless transmission.

When the control module 30 detects that the first electronic device 2 is only connected via the first wireless transmission path P1, the control module 30 controls the wireless transmission module 10 to cut off the connection with the first electronic device 2 via the first wireless transmission path P1. However, when the control module 30 detects that the first electronic device 2 is also connected via the second wireless transmission path P2, the control module 30 forces the wireless transmission module 10 to cut off connections with the first electronic device 2 via the first wireless transmission path P1 and second wireless transmission path P2, thereby preventing any subsequent connection problem when connecting with other electronic device such as the second electronic device 3.

Therefore, the second electronic device 3 can proceed to step S405 to be paired with the sound playing device.

Then the second electronic device 3 can be paired with the sound playing device 1.

The second electronic device 3 can then proceed to step S406 to request a connection via the first wireless transmission path P1, and the sound playing device 1 can proceed to step S407 to establish a connection with the second electronic device 3 via the first wireless transmission path P1.

The second electronic device 3 may also proceeds to step S408 to request a connection via the second wireless transmission path.

The second electronic device 3 can also performs the sound adjustment process to be connected via the second wireless transmission path P2.

Since the connection between the sound playing device 1 and the first electronic device 2 via the second wireless transmission path P2 is already cut off in step S404, the sound playing device 1 proceeds to step S409 to detect whether there is a connection via the first wireless transmission path.

The detection module 20 detects whether the wireless transmission module 10 is connected with the second electronic device 3 via the first wireless transmission path P1, that is, to check whether step S406 and S407 are performed.

Then the process proceeds to step S410: if yes, then enabling a connection via the second wireless transmission path, or to step S411, if no, then disabling a connection via the second wireless transmission path.

Finally, if there is a connection via the first wireless transmission path P1, in step S410 the control module 30 enables a connection via the second wireless transmission path P2. However, if there is no connection via the first wireless transmission path P1, in step S411 the control module 30 disables a connection via the second wireless transmission path P2.

At this time the first electronic device 2 may proceed to step S412 to request a connection via the second wireless transmission path.

In the process of step S401 to step S404, although the connection of first electronic device 2 via the first wireless transmission path P1 is disconnected, the first electronic device 2 still can try to establish a connection via the second wireless transmission path P2. Since in step S404 the connection with the first electronic device 2 via the second wireless transmission path P2 is already cut off, the sound playing device 1 proceeds to step S413 to detect whether there is a connection via the first wireless transmission path.

When a request by the first electronic device 2 to establish a connection via the second wireless transmission path P2 is received, the detection module 20 detects whether the wireless transmission module 10 is already connection with the second electronic device 3 via the first wireless transmission path P1.

Then the process proceeds to step S414: if yes, then enabling a connection via the second wireless transmission path, or to step S415, if no, then disabling a connection via the second wireless transmission path.

Finally if the connection via the first wireless transmission path P1 is established, the control module 30 enables a connection of the first electronic device 2 via the second wireless transmission path P2, as described in step S414. However, since the first wireless transmission path P1 of the sound playing device 1 is already connected with the second electronic device 3, it cannot be connected to the first electronic device 2. When the first electronic device 2 is not connected via the first wireless transmission path P1, the control module 30 disables the connection of the first electronic device 2 via the second wireless transmission path P2, as described in step S415.

It is noted that the connection establishing method of the present invention is not limited to the above-mentioned order of steps, and the order of the above steps can be changed as long as the object of the present invention can be achieved.

Therefore, it can be sure that the sound playing device 1 is connected to the first electronic device 2 via the first wireless transmission path P1 and the second wireless transmission path P2 simultaneously, and is also disconnected from the first wireless transmission path P1 and second wireless transmission path P2 simultaneously, thereby preventing any subsequent connection problem when connecting with other electronic device such as the second electronic device 3.

It is noted that the above-mentioned embodiments are only for illustration. It is intended that the present invention cover modifications and variations of this invention provided they fall within the scope of the following claims and their equivalents. However, it should be understood by those skilled in the art that the above modules or components may not be necessary. In order to implement the present invention, other more detailed conventional modules or elements may also be included. Each module or component may be omitted or modified as required, and no other module or component may exist between any two modules. Therefore, various modifications and variations can be made to the structure of the present invention without departing from the scope or spirit of the invention.

What is claimed is:

1. A sound playing device for connecting with an electronic device, the sound playing device comprising:

a sound module for producing a sound signal;

a wireless transmission module for establishing a connection with the electronic device via a first wireless transmission path or a second wireless transmission path, wherein the first wireless transmission path is used for transmitting an audio signal and the second wireless transmission path is used for transmitting a data signal;

a detection module electrically connected with the wireless transmission module and used for detecting whether the wireless transmission module is connected to the electronic device via the first wireless transmission path or the second wireless transmission path; and a control module electrically connected with the sound module and the detection module, the control module being used for controlling the sound module to produce the sound signal;

wherein: when the detection module detects that the electronic device requests to be connected via the second wireless transmission path, the detection module detects whether the electronic device is connected via the first wireless transmission path;

if the electronic device is connected via the first wireless transmission path, then the control module enables the connection with the electronic device via the second wireless transmission path; and if the electronic device is not connected via the first wireless transmission path, then the control module disables the connection with the electronic device via the second wireless transmission path.

2. The sound playing device as claimed in claim 1, when the detection module detects that the electronic device is to be disconnected from the first wireless transmission path, the control module controls the wireless transmission module to simultaneously cut off connections with the electronic device via the first wireless transmission path and the second wireless transmission path.

3. The sound playing device as claimed in claim 1, wherein the detection module further records transmission addresses of the first transmission path and the second transmission path.

4. The sound playing device as claimed in claim 1, when the electronic device performs a sound adjustment process, the control module controls the wireless transmission module to connect with the electronic device via the second wireless transmission path to receive the data signal.

5. The sound playing device as claimed in claim 4, wherein the control module changes the sound signal produced by the sound module according to the data signal.

6. The sound playing device as claimed in claim 1, wherein the first wireless transmission path and the second wireless transmission path provide transmissions by using a Bluetooth communication protocol.

7. The sound playing device as claimed in claim 1, wherein the sound playing device is a headphone device.

8. A connection establishing method for connecting a sound playing device with an electronic device; the method comprising the following steps:

detecting whether a wireless transmission module is connected to the electronic device via a first wireless transmission path or a second wireless transmission path, wherein the first wireless transmission path is used for transmitting an audio signal and the second wireless transmission path is used for transmitting a data signal;

when the electronic device requests to be connected via the second wireless transmission path, detecting whether the electronic device is connected via the first wireless transmission path;

if the electronic device is connected via the first wireless transmission path, then enabling the connection with the electronic device via the second wireless transmission path; and if the electronic device is not connected via the first wireless transmission path, then disabling the connection with the electronic device via the second wireless transmission path.

9. The connection establishing method as claimed in claim 8 further comprising the following steps:

when the electronic device is to be disconnected from the first wireless transmission path, detecting whether there is a connection via the second wireless transmission path; and if yes, then simultaneously cutting off connections with the electronic device via the first wireless transmission path and the second wireless transmission.

10. The connection establishing method as claimed in claim 8 further comprising the step of recording transmission addresses of the first transmission path and the second transmission path.

11. The connection establishing method as claimed in claim 8 further comprising the step of controlling the wireless transmission module to connect with the electronic device via the second wireless transmission path to receive the data signal when performing a sound adjustment process on the electronic device.

12. The connection establishing method as claimed in claim 11 further comprising the step of changing a sound signal produced by the sound module according to the data signal.

* * * * *